US009157136B2

(12) United States Patent
Chou et al.

(10) Patent No.: US 9,157,136 B2
(45) Date of Patent: Oct. 13, 2015

(54) MULTI-ELEMENT ALLOY MATERIAL AND METHOD OF MANUFACTURING THE SAME

(71) Applicant: INDUSTRIAL TECHNOLOGY RESEARCH INSTITUTE, Hsinchu (TW)

(72) Inventors: Yu-Hsien Chou, Tainan (TW); Chih-Chao Yang, Hsinchu (TW)

(73) Assignee: INDUSTRIAL TECHNOLOGY RESEARCH INSTITUTE, Hsinchu (TW)

( * ) Notice: Subject to any disclaimer, the term of this patent is extended or adjusted under 35 U.S.C. 154(b) by 418 days.

(21) Appl. No.: 13/727,131

(22) Filed: Dec. 26, 2012

(65) Prior Publication Data

US 2014/0150932 A1 Jun. 5, 2014

(30) Foreign Application Priority Data

Dec. 5, 2012 (TW) ..... 101145745 A

(51) Int. Cl.

| | |
|---|---|
| ***C22C 30/00*** | (2006.01) |
| ***C22C 27/04*** | (2006.01) |
| ***C22C 27/06*** | (2006.01) |
| ***C22F 1/16*** | (2006.01) |
| ***C22F 1/18*** | (2006.01) |

(52) U.S. Cl.

CPC ..... *C22C 30/00* (2013.01); *C22C 27/04* (2013.01); *C22C 27/06* (2013.01); *C22F 1/16* (2013.01); *C22F 1/18* (2013.01)

(58) Field of Classification Search

CPC ..... C22C 30/00; C22C 27/04; C22C 27/06

See application file for complete search history.

(56) References Cited

U.S. PATENT DOCUMENTS

| | | | | |
|---|---|---|---|---|
| 6,491,767 | B1 * | 12/2002 | Kuehmann | 148/318 |
| 7,887,747 | B2 | 2/2011 | Iwasaki et al. | |
| 8,128,867 | B2 | 3/2012 | Iwasaki et al. | |

(Continued)

FOREIGN PATENT DOCUMENTS

| | | |
|---|---|---|
| CN | 2514006 Y | 10/2002 |
| CN | 1990907 A | 7/2007 |

(Continued)

OTHER PUBLICATIONS

M. Blaow, J.T. Evans, B.A. Shaw Effect of hardness and composition gradients on Barkhausen emission in case hardened steel vol. 303, Issue 1, Aug. 2006, pp. 153-159.*

(Continued)

*Primary Examiner* — Roy King
*Assistant Examiner* — Jenny Wu
(74) *Attorney, Agent, or Firm* — McClure, Qualey & Rodack, LLP

(57) ABSTRACT

A multi-element alloy material consists of Al, Cr, Fe, Mn, Mo and Ni. From an outer surface to a center of the multi-element alloy material exhibits a hardness gradient from high to low. A method of manufacturing a multi-element alloy material with hardness gradient includes melting and casting metals with a metal combination of Al, Cr, Fe, Mn, Mo and Ni to form an alloy body, subjecting the alloy body to a homogenization treatment, and subjecting the homogenized alloy body to a high temperature treatment to perform precipitation hardening at surface of the alloy body by heating, thereby forming a multi-element alloy material having hardness gradient.

11 Claims, 4 Drawing Sheets

(56) References Cited

U.S. PATENT DOCUMENTS

| | | | | |
|---|---|---|---|---|
| 2008/0289730 | A1 | 11/2008 | Ishida et al. | |
| 2011/0011499 | A1 * | 1/2011 | Lengauer et al. | 148/526 |
| 2011/0109020 | A1 | 5/2011 | Iwasaki et al. | |
| 2011/0180413 | A1 | 7/2011 | Whitaker et al. | |

FOREIGN PATENT DOCUMENTS

| | | | |
|---|---|---|---|
| CN | 101134237 | A | 3/2008 |
| CN | 101158041 | A | 4/2008 |
| CN | 101545058 | B | 10/2010 |
| CN | 102002664 | A | 4/2011 |
| CN | 102134660 | B | 7/2012 |
| CN | 102560169 | A | 7/2012 |
| JP | 5148615 | | 6/1993 |
| JP | H6-57401 | A | 3/1994 |
| TW | 379253 | B | 1/2000 |
| TW | 460587 | B | 10/2001 |
| TW | I298745 | | 7/2008 |
| TW | 201219343 | | 5/2012 |
| TW | 201226127 | | 7/2012 |
| WO | 2007066555 | A1 | 6/2007 |
| WO | 2009102999 | A1 | 8/2009 |

OTHER PUBLICATIONS

TW Office Action dated Aug. 27, 2014.
English Abstract translation of CN102560169 (Published Jul. 11, 2012).
English Abstract translation of JP-H6-57401 (Published Mar. 1, 1994).
English abstract translation of CN102134660 (Published Jul. 4, 2012).
English abstract translation of CN102002664 (Published Apr. 6, 2011).
English abstract translation of CN101545058 (Published Oct. 6, 2010).
English abstract translation of CN101158041 (Published Apr. 9, 2008).
English abstract translation of CN101134237 (Published Mar. 5, 2008).
English abstract translation of CN2514006 (Published Oct. 2, 2002).
English abstract translation of CN1990907 (Published Jul. 4, 2007).
English abstract translation of TW460587 (Published Oct. 21, 2001).
English abstract translation of TW379253 (Published Jan. 11, 2000).
English abstract translation of TWI298745 (Published Jul. 11, 2008).
English abstract translation of TW201219343 (Published May 16, 2012).
English abstract translation of TW201226127 (Published Jul. 1, 2012).
English abstract translation of JP5148615 (Published Jun. 15, 1993).
English abstract translation of RU2218448 (Published Dec. 10, 2003).
"Formation of the gradient structure in sintered hard alloys (Review)"; Journal of Superhard Materials, v 32, n 4, p. 250-262, Aug. 2010; ISSN: 10634576, E-ISSN: 19349408; DOI: 10.3103/S1063457610040040; Publisher: Allerton Press Inc.
"Wear behavior of SiCp/Al—Si alloy functionally gradient material"; Mocaxue Xuebao/Tribology, v 21, n 2, p. 151-153, Mar. 2001; Language: Chinese; ISSN: 10040595; Publisher: Science Press.
"Formation mechanism of cobalt-gradient structure in WC—Co hard alloy"; Journal of Materials Science 39 (2004) 4397-4399.
"Gradient structure W(Mo)—Ni—Fe tungsten heavy alloy", Fenmo Yejin Cailiao Kexue yu Gongcheng/Materials Science and Engineering of Powder Metallurgy, v 16, n 2, p. 201-205, Apr. 2011; Language: Chinese; ISSN: 16730224; Publisher: Central South University.
"316L stainless steel/Ni-based alloy/Ti6Al4V gradient materials prepared by laser rapid forming process"; Jinshu Xuebao/Acta Metallurgica Sinica, v 44, n 7, p. 826-830, Jul. 2008; Language: Chinese; ISSN: 04121961; Publisher: Chinese Academy of Sciences.
"The tribological properties of a gradient layer prepared by plasma-based ion implantation on 2024 aluminum alloy"; 0257-8972/04/$—see front matter Copyright 2003 Elsevier B.V. All rights reserved. doi:10.1016/j.surfcoat.2003.10.003.

* cited by examiner

MULTI-ELEMENT ALLOY MATERIAL AND METHOD OF MANUFACTURING THE SAME

This application claims the benefit of Taiwan application Serial No. 101145745, filed Dec. 5, 2012, the disclosure of which is incorporated by reference herein in its entirety.

TECHNICAL FIELD

The technical field relates to a multi-element alloy material and method of manufacturing the same.

BACKGROUND

The hard alloy material has characteristics of high hardness, high strength, good wear resistance, good corrosion resistance, low thermal expansion coefficient and high chemical stability. Even at high temperature, the hard alloy material still has high hardness, which is widely applied to various kinds of the products such as mechanical processing, metal mould, cutting tools, etc. For the practical application of hard alloy material, it is desired to choose a hard alloy material with the high hardness and wear resistance outside, and with the high ductility inside for bearing an external impact and stopping the crack propagation from the surface to the center. However, the conventional hard alloy material possesses the consistent physical and mechanical properties, from the outer surface to the inside of the material.

Various modifications on the hard alloy materials have been studied and proposed. For example, single layer or multi layers (as a coating layer) made of material with high hardness and good wear resistance are deposited on the surface of an alloy (as a base) by chemical vapor deposition (CVD) or physical vapor deposition (PVD), thereby forming a hard alloy with a ductile core and a hard surface by using different materials. However, there is an interface between the coating layer and the base of this hard alloy. Different thermal expansion coefficients of different materials have considerable effects on the performance and life of product manufactured by this hard alloy.

With advancements in technology and requirements of hard alloy quality of the applications, it is one of important goals to improve the physical and mechanical properties of the alloy materials, with not only the hard surface and the ductile inside but also the extended product life and the progress in performance.

SUMMARY

According to the disclosure, a multi-element alloy material of Al, Cr, Fe, Mn, Mo and Ni is provided. The multi-element alloy material exhibits a hardness gradient from high to low correspondingly from an outer surface to a center.

According to the disclosure, a method of manufacturing a multi-element alloy material is provided. A metal combination consisting of Al, Cr, Fe, Mn, Mo and Ni is provided. The metal combination is melted to form an alloy. The alloy is casted to form an alloy body. The alloy body is subjected to a homogenization treatment to form a homogenized alloy body. The homogenized alloy body is subjected to a high temperature treatment to perform precipitation hardening at surface of the alloy body by heating, thereby forming a multi-element alloy material having a hardness gradient.

DETAILED DESCRIPTION

Figure 1:
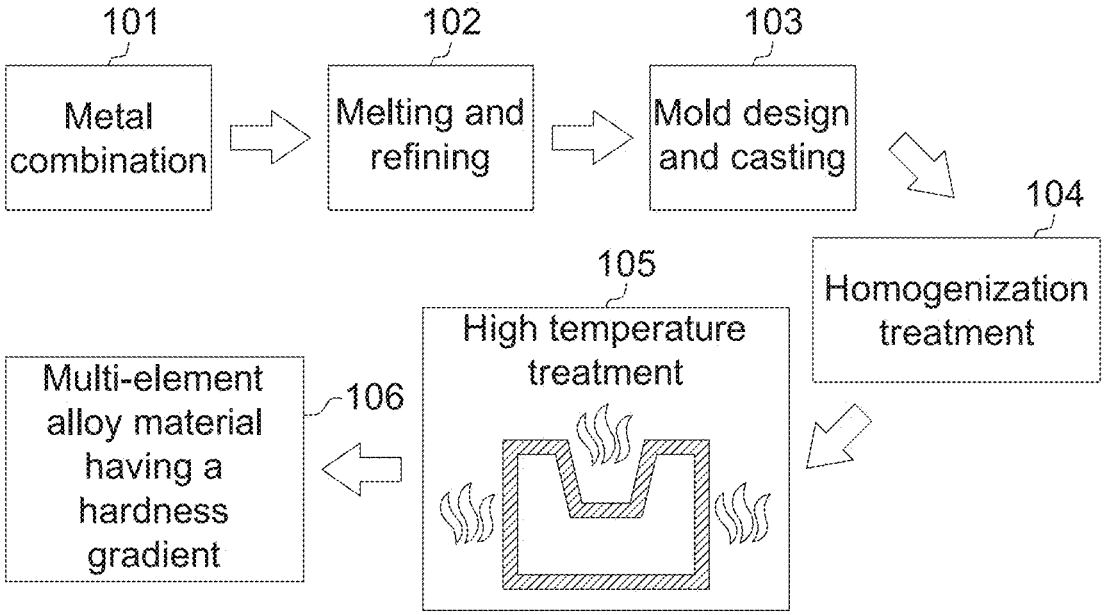
FIG. 1 illustrates a method for manufacturing a multi-element alloy material according to the embodiment of the disclosure.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

A multi-element alloy material comprising Al, Cr, Fe, Mn, Mo and Ni is disclosed in the embodiment. After a homogenization treatment followed by a high temperature treatment such as a high-frequency rapid heating treatment, the precipitation hardening occurs at surface of the alloy material so that the alloy material exhibits a hardness gradient without distinct interface inside. The multi-element alloy material of the embodiment possesses the high hardness and wear resistance outside and the high ductility and low internal stress inside. Also, due to the properties of the continuous hardness gradient and no distinct interfaces inside, it is not easy to crack the multi-element alloy material of the embodiment, and the production life is extended consequently. Moreover, the manufacturing method of the embodiment is simple and rapid. The simple equipment could be adopted for processing the manufacturing method, which decreases the production cost, saves the manufacturing time and is also suitable for the fabrication of the for the multi-element alloy material with large area.

The embodiments of the present disclosure disclosed below are for elaborating a multi-element alloy material of the embodiment and method of manufacturing the same. However, the descriptions disclosed in the embodiments of the disclosure such as metal proportions of the multi-element alloy material, measurement results and details of manufacturing steps are for exemplary and illustration only, not for limiting the scope of protection of the disclosure.

In one embodiment, a multi-element alloy material consists of Al, Cr, Fe, Mn, Mo and Ni (which is abbreviated as "AlCrFeMnMoNi" or the likes hereinafter), and exhibits a hardness gradient changed from high to low correspondingly from an outer surface inward (i.e. along an inward cross-sectional direction) of the multi-element alloy material. Also, there are no distinct interfaces presented from the outer surface to the center of the multi-element alloy material. In the embodiment, the outer surface of the multi-element alloy material has a sufficient hardness, such as a surface hardness with at least 400Hv. In one embodiment, at least a portion of the multi-element alloy material having a thickness of 1 mm horizontally inward from the outer surface exhibits at least 400Hv of the surface hardness.

In one embodiment, a center (/core zone) of the multi-element alloy material of AlCrFeMnMoNi has a core hardness of 300Hv to 500Hv, while the surface hardness thereof is in a range of 700Hv to 1200Hv.

In another embodiment, a center (/core zone) of the multi-element alloy material of AlCrFeMnMoNi has a core hardness of 400Hv to 500Hv, while the surface hardness thereof is in a range of 800Hv to 1200Hv.

In one embodiment, the outer surface of the multi-element alloy material of AlCrFeMnMoNi exhibits a surface hardness with at least 400Hv, and a portion having a thickness of at least 5 mm horizontally inward from the outer surface exhibits that surface hardness.

In one embodiment, the outer surface of the multi-element alloy material of AlCrFeMnMoNi exhibits a surface hardness with at least 400Hv, and a portion having a thickness of about 1 mm to 10 mm horizontally inward from the outer surface exhibits that surface hardness.

In one embodiment, the strain fracture toughness (Kic) of the multi-element alloy material of AlCrFeMnMoNi is 6 at least.

In one embodiment, the multi-element alloy material of AlCrFeMnMoNi has the same number of moles of Fe, Mn and Ni.

In one embodiment, the multi-element alloy material of AlCrFeMnMoNi is a compound represented by $Al_xCr_yFe_{0.2}Mn_{0.2}Mo_ZNi_{0.2}$, including 0.2 mole of Fe, 0.2 mole of Mn, 0.2 mole of Ni, x mole of Al, y mole of Cr and z mole of Mo, wherein x is ranged from 0.1 to 0.4, y is ranged from 2.5 to 4, and z is ranged from 1.5 to 2.5.

It is noted that the physical properties (such as the core hardness, the surface hardness and the related thickness) of the multi-element alloy materials illustrated above are just some exemplifications of experimental data, not for limiting the scope of protection of the disclosure. In practical applications, the metal proportions of the multi-element alloy material could be adjusted and changed according to the application requirements, and the physical properties would be varied with the different metal proportions and processing conditions (such as time and temperature of the heating treatment).

A method for manufacturing a multi-element alloy material of the embodiment is disclosed below for illustration. Please refer to FIG. 1, which illustrates a method for manufacturing a multi-element alloy material according to the embodiment of the disclosure. However, the descriptions disclosed herein such as manufacturing steps and processing conditions are for illustration only, not for limiting the scope of protection of the disclosure. The manufacturing steps of the method could be adjusted and changed in order to meet the application requirements (such as the needs of the surface hardness, the core hardness, the strain fracture toughness (Kic), etc.) of the products.

In step 101, a metal combination consisting of Al, Cr, Fe, Mn, Mo and Ni is provided. This metal combination possesses characteristics of fast precipitation hardening at surface and low thermal conductivity. The metal proportions of the multi-element alloy material could be selected and adjusted as described before. Table 1 lists mole ratios of metals in the multi-element alloy materials according to nine of experiments of the embodiment. In the nine experiments of Table 1, the moles of Fe, Mn and Ni are 0.2.

In step 102, the metal combination is melted to form an alloy with uniform distribution. In one embodiment, the metal combination is subjected to an arc-melting to form the alloy with uniform distribution.

In step 103, after melting step, the alloy is cast to mould into an alloy body, such as by mold casting.

Figure 2:
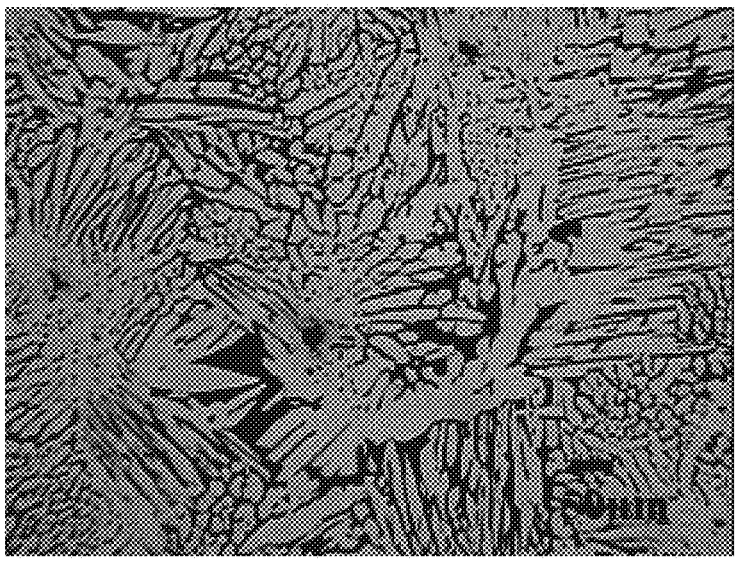
FIG. 2 shows an optical microscopy (OM) image of a homogenized alloy body of $Al_{0.3}Cr_{0.5}Fe_{0.2}Mn_{0.2}Mo_{0.5}Ni_{0.2}$ after the homogenization treatment.

In step 104, the alloy body is subjected to a homogenization treatment to form a homogenized alloy body. In one embodiment, the homogenization treatment could be a heating treatment. The alloy body exhibits dendritic segregation and complicated precipitation. The alloy body could be annealed in a sufficient high temperature for a sufficient long time to diffuse and eliminate the segregation of the metals, thereby obtaining a homogenized alloy body with a uniform microstructure and hardness. Other techniques for homogenization of the alloy body could be adopted in the embodiments. FIG. 2 shows an optical microscopy (OM) image of a homogenized alloy body of $Al_{0.3}Cr_{0.5}Fe_{0.2}Mn_{0.2}Mo_{0.5}Ni_{0.2}$ after the homogenization treatment. In one embodiment, the alloy body could be annealed in a high temperature of about 400° C. to about 800° C. for about 4 hours to about 10 hours. In another embodiment, the alloy body could be annealed in a high temperature of about 500° C. to about 700° C. for about 5 hours to about 8 hours.

In step 105, the homogenized alloy body is subjected to a high temperature treatment to perform precipitation hardening at surface of the alloy body by heating, thereby forming a multi-element alloy material having a hardness gradient (step 106).

In one embodiment, the high temperature treatment could be conducted by a high-frequency rapid heating treatment in a high-frequency heating system (ex: high frequency inductive heater).

The homogenized alloy body subjected to the high-frequency rapid heating treatment would cause precipitation hardening at the portion near the outer surface (ex: with the outer hardness of 400Hv at least, such as higher than 800Hv), and forms amorphous and extended cubic microstructure inside which is an obstacle to phonon scattering and electrons mobility. Therefore, the inside of the multi-element alloy material has lower thermal conductivity and would not be hardened during the high-frequency rapid heating treatment, thereby possessing the high ductility. Accordingly, the multi-element alloy material with a hardened surface and a high-ductile and low-thermal deformed inside is obtained by the manufacturing method of the embodiment disclosed herein.

For a high-frequency rapid heating system, a source of high frequency electricity is used to drive a large alternating current through an induction coil (known as the work coil). The passage of current through this coil generates a very intense and rapidly changing magnetic field in the space within the work coil. In one embodiment, the high-frequency rapid heating treatment could be conducted by placing the homogenized alloy body of AlCrFeMnMoNi inside the induction heating coil and within this intense alternating magnetic field. The alternating magnetic field induces a current flow in the conductive homogenized alloy body of AlCrFeMnMoNi. Also, a skin effect forces the alternating current to flow towards the surface of the homogenized alloy body of AlCrFeMnMoN (i.e. the high frequency used in induction heating applications gives rise to a phenomenon called the skin effect) . The skin effect increases the effective resistance of the metal to the passage of the large current. Therefore it greatly increases the induction heating effect of the induction heater caused by the current induced in the workpiece (i.e. the homogenized alloy body of AlCrFeMnMoN placed in the coils). In other words, the arrangement of the work coil and the homogenized alloy body of AlCrFeMnMoN causes tremendous currents to flow through the homogenized alloy body of AlCrFeMnMoN. Accordingly, the homogenized alloy body of AlCrFeMnMoN placed in the coils is rapidly heated to high temperatures at surface by induced currents from the highly concentrated magnetic field, thereby forming a multi-element alloy material having a hardness gradient with sufficient surface hardness and without distinct interfaces inside. However, the disclosure is not limited to the method of high-frequency rapid heating treatment as described above. Other high temperature treatment that would cause precipitation hardening at the surface could be adopted for forming the multi-element alloy material of the embodiment.

In one embodiment, the high-frequency rapid heating treatment could be performed in a temperature of about 500° C. to about 1200° C. In another embodiment, the high-frequency rapid heating treatment could be performed in a temperature of about 800° C. to about 1100° C. In one embodiment, the high-frequency rapid heating treatment could be performed for about 8 minutes to about 20 minutes.

According to the manufacturing method above, a multi-element alloy material of AlCrFeMnMoN as manufactured has serve distortion of the crystal lattice and results in the low thermal conductivity (ex: about 8~10 W/m·K), thereby creating a larger hardness gradient within a certain thickness of the multi-element alloy material. With property of the low thermal conductivity of AlCrFeMnMoN and step of precipitation hardening at the surface by heating, a multi-element alloy material having high ductility and low internal stress inside and high hardness and wear resistance outside could be formed, by subjecting the surface of the alloy to a rapid heating treatment. Consequently, the multi-element alloy material of the embodiment exhibits a hardness gradient changed from high to low correspondingly from the outer surface inward of the multi-element alloy material, and also no distinct interfaces. Moreover, the manufacturing method of the embodiment is simple and rapid. The simple equipment could be adopted for processing the manufacturing method, which decreases the production cost, saves the manufacturing time and is also suitable for the fabrication of the for the multi-element alloy material with large area. In the application of rapid tooling for the alloy material of AlCrFeMnMoN, the method for manufacturing the multi-element alloy material according to the embodiment has several advantages such as rapid prototyping, extension of tool life and decrease of production cost.

Several experiments and related property tests are provided below for illustration. It is noted that the parameters disclosed in the experiments, such as metal proportions, heating time and temperature . . . etc, are only for description, not for limitation.

First Experiment

A metal combination of Al, Cr, Fe, Mn, Mo and Ni with certain designed mole ratios is provided, and melted to form an alloy of $Al_xCr_yFe_{0.2}Mn_{0.2}Mo_ZNi_{0.2}$ by arc-melting. The alloy is casted to form an alloy body. Table 1 lists mole ratios of metals in the multi-element alloy materials according to nine examples of the embodiment. The alloy body is subjected to a homogenization treatment (by a heat treatment at 600° C. for 7 hours), and then a high-frequency rapid heating treatment at 500° C. for 15 minutes to form a multi-element alloy material.

Figure 3:
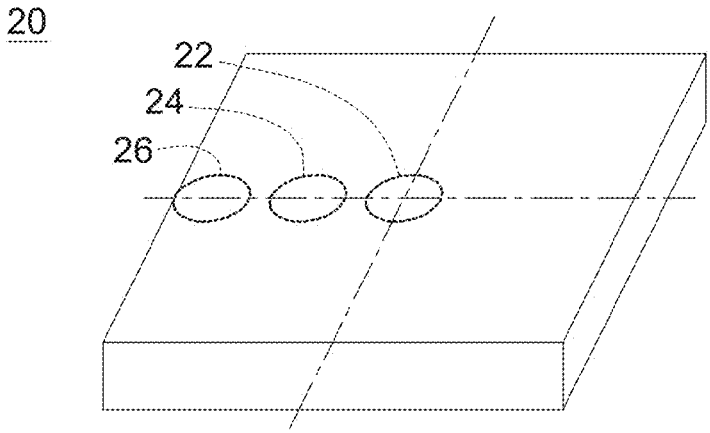
FIG. 3 shows the test positions of the core zone, the intermediate zone and the surface zone of the multi-element alloy material according to the first to fourth experiments.

In the experiments, three test positions are determined from an outer surface to a center (along an inward cross-sectional direction) of the multi-element alloy material for hardness measurement, including a core zone, an intermediate zone and a surface zone. Table 2 lists hardness results measured from positions of the core zone, the intermediate zone and the surface zone of the multi-element alloy material examples in the first experiment, wherein about 1 mm-5 mm horizontally inward from the outer surface is determined as the surface zone, about 5 mm-21 mm horizontally inward from the outer surface is determined as the intermediate zone, and the central portion is determined as the core zone (as depicted in FIG. 3). FIG. 3 shows the test positions of the core zone 22, the intermediate zone 24 and the surface zone 26 of the multi-element alloy material 20 according to the first to fourth experiments, wherein the test positions are determined on a cross-sectional surface of the multi-element alloy material. It is noted that the three test positions depicted in FIG. 3 are determined for experimental measurements, not for limiting the definition of hardness zones of the multi-element alloy material of the disclosure. Also, the terms of core zone, intermediate zone and surface zone herein are taken for describing these test positions. As indicated in Table 2, the examples of the multi-element alloy materials of $Al_xCr_yFe_{0.2}Mn_{0.2}Mo_ZNi_{0.2}$ of the first experiment have property of precipitation hardening at the surface, and have presented a hardness gradient changed from high to low correspondingly from the outer surface to the center thereof (i.e. surface zone hardness>intermediate zone hardness>core zone hardness).

Second Experiment

A metal combination of Al, Cr, Fe, Mn, Mo and Ni with certain designed mole ratios is provided, and melted to form an alloy of $Al_xCr_yFe_{0.2}Mn_{0.2}Mo_ZNi_{0.2}$ by arc-melting. The alloy is casted to form an alloy body. Table 1 lists mole ratios of metals in the multi-element alloy materials according to nine examples of the embodiment. The alloy body is subjected to a homogenization treatment (by a heat treatment at 500° C. for 8 hours), and then a high-frequency rapid heating treatment at 800° C. for 15 minutes to form a multi-element alloy material.

Table 3 lists hardness results measured from three test positions of the core zone, the intermediate zone and the surface zone of the multi-element alloy material examples in the second experiment, wherein about 1 mm-5 mm horizontally inward from the outer surface is determined as the surface zone, about 5 mm-21 mm horizontally inward from the outer surface is determined as the intermediate zone, and the central portion is determined as the core zone (as depicted in FIG. 3). As indicated in Table 3, the examples of the multi-element alloy materials of $Al_xCr_yFe_{0.2}Mn_{0.2}Mo_ZNi_{0.2}$ according to the second experiment have property of precipitation hardening at the surface, and have also presented a hardness gradient changed from high to low correspondingly from the outer surface to the center thereof (i.e. surface zone hardness>intermediate zone hardness>core zone hardness).

Third Experiment

A metal combination of Al, Cr, Fe, Mn, Mo and Ni with certain designed mole ratios is provided, and melted to form an alloy of $Al_xCr_yFe_{0.2}Mn_{0.2}Mo_ZNi_{0.2}$ by arc-melting. The alloy is casted to form an alloy body. The mole ratios of metals in the nine multi-element alloy material examples (T1~T9) are listed in Table 1. The alloy body is subjected to a homogenization treatment (by a heat treatment at 700° C. for 6 hours), and then a high-frequency rapid heating treatment at 1100° C. for 10 minutes to form a multi-element alloy material.

Table 4 lists hardness results measured from three test positions of the core zone, the intermediate zone and the surface zone of the multi-element alloy material samples in the third experiment, wherein about 1 mm-5 mm horizontally inward from the outer surface is determined as the surface zone, about 5 mm-21 mm horizontally inward from the outer surface is determined as the intermediate zone, and the central portion is determined as the core zone (as depicted in FIG. 3). As indicated in Table 4, the examples of the multi-element alloy materials of $Al_xCr_yFe_{0.2}Mn_{0.2}Mo_ZNi_{0.2}$ according to the third experiment have property of precipitation hardening at the surface, and have also presented a hardness gradient changed from high to low correspondingly from the outer surface to the center thereof.

Fourth Experiment

In the fourth experiment, a metal combination of Al, Cr, Fe, Mn, Mo and Ni with 0.4 of mole ratio of Al and varied mole ratios of Cr and Mo is provided, and melted to form the alloys with three different mole ratios of metals by arc-melting, which are $Al_{0.4}Cr_{3.5}Fe_{0.2}Mn_{0.2}Mo_{2.0}Ni_{0.2}$, $Al_{0.4}Cr_{3.5}Fe_{0.2}Mn_{0.2}Mo_{2.5}Ni_{0.2}$ and $Al_{0.4}Cr_{4.0}Fe_{0.2}Mn_{0.2}Mo_{2.5}Ni_{0.2}$. Each alloy is casted to form an alloy body. The alloy body is subjected to a homogenization treatment (by a heat treatment at 600° C. for 7 hours), and then a high-frequency rapid heating treatment at 1100° C. for 10 minutes to form a multi-element alloy material.

Table 5 lists hardness results measured from three test positions of the core zone, the intermediate zone and the surface zone of the multi-element alloy material examples in the fourth experiment, wherein about 1 mm-5 mm horizontally inward from the outer surface is determined as the surface zone, about 5 mm-21 mm horizontally inward from the outer surface is determined as the intermediate zone, and the central portion is determined as the core zone (as depicted in FIG. 3). As indicated in Table 5, three multi-element alloy materials according to the fourth experiment have property of precipitation hardening at the surface, and have also presented a hardness gradient changed from the high to low correspondingly from the surface zone to the core zone. Also, each of the multi-element alloy materials according to the fourth experiment has the surface zone hardness of more than 800Hv.

Figure 4:
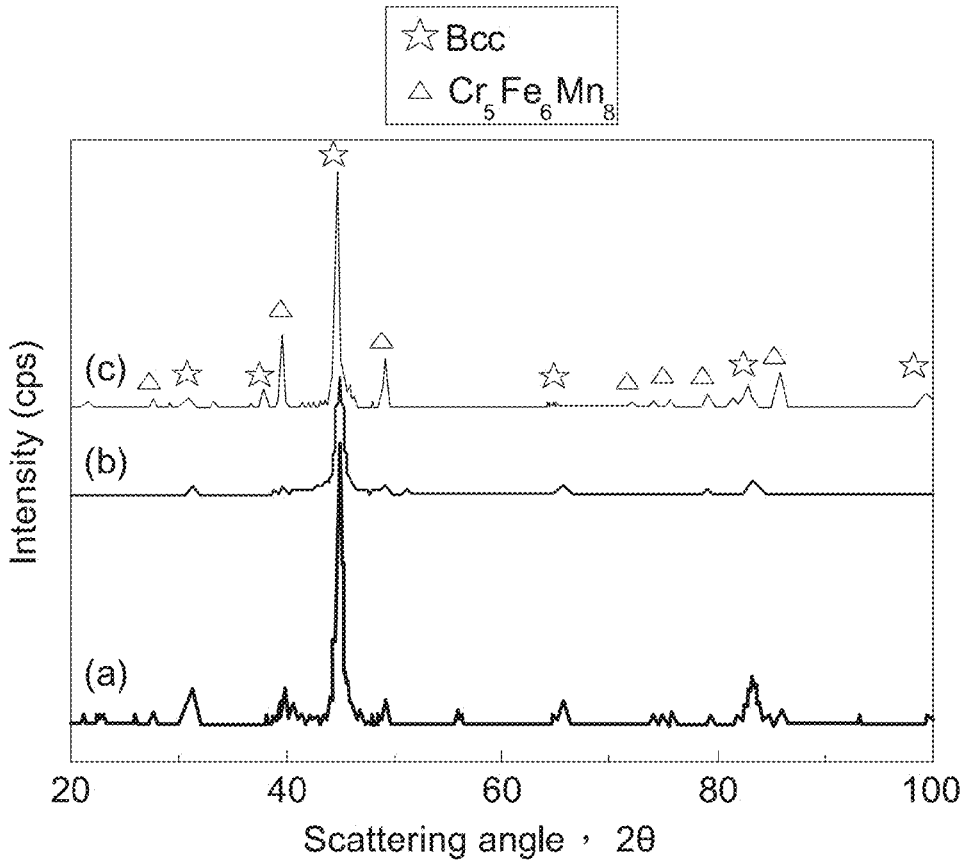
FIG. 4 is X-ray diffraction intensity versus the scattering angle 2θ for the multi-element alloy materials of $Al_{0.4}Cr_{3.5}Fe_{0.2}Mn_{0.2}Mo_{2.0}Ni_{0.2}$ (a), $Al_{0.4}Cr_{3.5}Fe_{0.2}Mn_{0.2}Mo_{2.5}Ni_{0.2}$ (b) and $Al_{0.4}Cr_{4.0}Fe_{0.2}Mn_{0.2}Mo_{2.5}Ni_{0.2}$ (c).

Also, an X-ray diffraction (XRD) is conducted to investigate the crystal structures of three multi-element alloy materials in the fourth experiment. FIG. 4 is X-ray diffraction intensity versus the scattering angle 2θ for the multi-element alloy materials of $Al_{0.4}Cr_{3.5}Fe_{0.2}Mn_{0.2}Mo_{2.0}Ni_{0.2}$ (a), $Al_{0.4}Cr_{3.5}Fe_{0.2}Mn_{0.2}Mo_{2.5}Ni_{0.2}$ (b) and $Al_{0.4}Cr_{4.0}Fe_{0.2}Mn_{0.2}Mo_{2.5}Ni_{0.2}$ (c). The XRD results have indicated that the crystal structures of these three multi-element alloy materials of the fourth experiment are amorphous and extended cubic, which would decrease the thermal conductivity of the alloy materials. According to the measurement results, the thermal conductivities of the multi-element alloy materials are in a range of about 8 W/m·k to about 10 W/m·k.

Fifth Experiment

In the fifth experiment, a metal combination is melted to form the alloy of $Al_{0.4}Cr_{3.5}Fe_{0.2}Mn_{0.2}Mo_{2.5}Ni_{0.2}$ by arc-melting. The alloy is casted to form an alloy body, and the alloy body is subjected to a homogenization treatment (by a heat treatment at 600° C. for 7 hours). A high-frequency rapid heating treatment is then conducted at 1100° C. for 5, 10 and 20 minutes, thereby forming three multi-element alloy materials.

Figure 5:
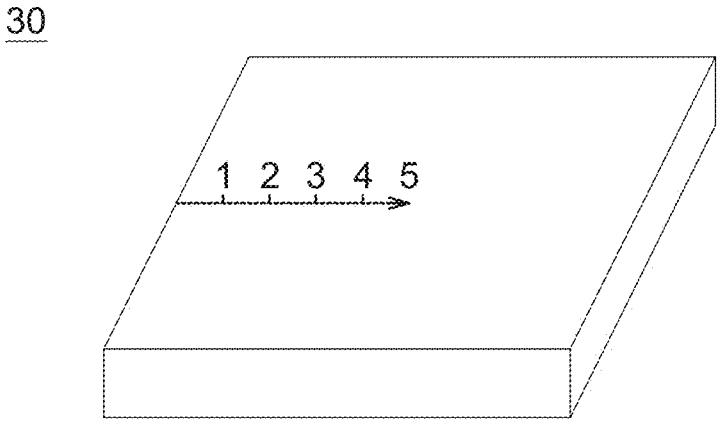
FIG. 5 shows five of test positions of the multi-element alloy material 30 according to the fifth experiment

Table 6 lists the hardness results measured from five test positions from the outer surface to the center of the multi-element alloy material examples with different heating times (i.e. 5/10/20 minutes) of the high-frequency rapid heating treatment in the fifth experiment. FIG. 5 shows five of test positions of the multi-element alloy material 30 according to the fifth experiment, wherein the test positions 1 to 5 are determined on a cross-sectional surface of the multi-element alloy material 30 along a cross-sectional direction from the outer surface to the center thereof. As depicted in FIG. 5, about 0 mm-2 mm horizontally inward from the outer surface to the center is determined as the position 1, about 3 mm-5 mm horizontally inward from the outer surface to the center is determined as the position 2, about 7 mm-10 mm horizontally inward from the outer surface to the center is determined as the position 3, about 16 mm-18 mm horizontally inward from the outer surface to the center is determined as the position 4 and about 21 mm-25 mm horizontally inward from the outer surface to the center is determined as the position 5 in the fifth experiment.

Figure 6:
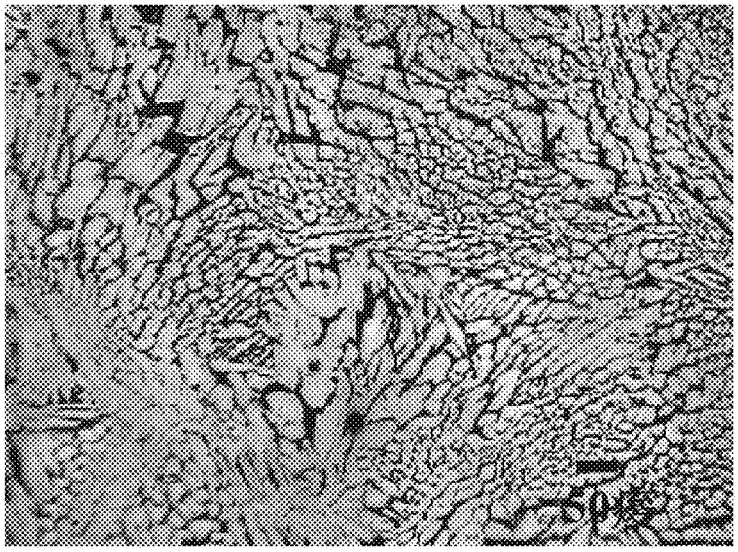
FIG. 6 shows an optical microscopy (OM) image of a central portion of multi-element alloy material of $Al_{0.4}Cr_{3.5}Fe_{0.2}Mn_{0.2}Mo_{2.5}Ni_{0.2}$ after the high-frequency rapid heating treatment conducted at 1100° C. for 10 minutes.

The results of Table 6 have indicated that the multi-element alloy materials according to the fifth experiment have property of precipitation hardening at the surface and a hardness gradient changed regularly from high to low correspondingly from the outer surface to the center. When the high-frequency rapid heating treatment is conducted at 1100° C. for 10 and more than 10 minutes, the multi-element alloy material has the surface zone hardness of more than 800Hv. FIG. 6 shows an optical microscopy (OM) image of a central portion of multi-element alloy material of $Al_{0.4}Cr_{3.5}Fe_{0.2}Mn_{0.2}Mo_{2.5}Ni_{0.2}$ after the high-frequency rapid heating treatment conducted at 1100° C. for 10 minutes. The dendritic microstructure facilitates the ductility of the multi-element alloy material.

Sixth Experiment

Effects of different heating temperatures of the homogenization treatment on the alloy materials are investigated in the sixth experiment. In the sixth experiment, a metal combination is melted to form the alloy of $Al_{0.4}Cr_{3.5}Fe_{0.2}Mn_{0.2}Mo_{2.5}Ni_{0.2}$ by arc-melting. The alloy is casted to form an alloy body, and the alloy body is subjected to a homogenization treatment. After homogenization treatment, the hardness measurements of couple test positions of the homogenized alloy body are conducted.

Figure 7:
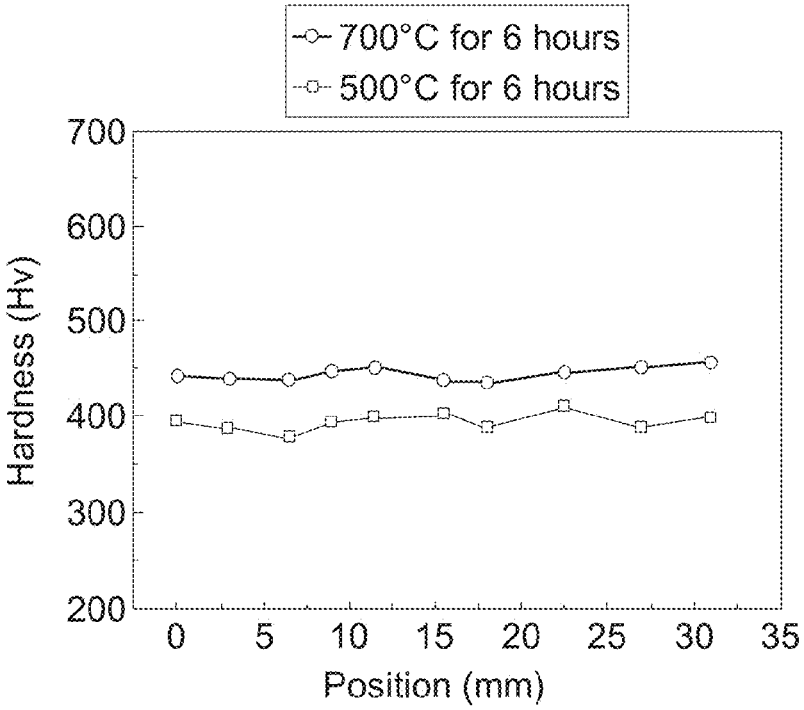
FIG. 7 shows the hardness results of different test positions of the alloy of $Al_{0.4}Cr_{3.5}Fe_{0.2}Mn_{0.2}Mo_{2.5}Ni_{0.2}$ after homogenization treatment with different heating temperatures.

FIG. 7 shows the hardness results of different test positions of the alloy of $Al_{0.4}Cr_{3.5}Fe_{0.2}Mn_{0.2}Mo_{2.5}Ni_{0.2}$ after homogenization treatment with different heating temperatures. In FIG. 7, 0 mm at x-axis represents the position of the outer surface of the alloy, while 35 mm at x-axis represents the position of the center of the alloy. According to the results of FIG. 7, the homogenized alloy body has the hardness in the range of 380Hv~410Hv after 500° C. of homogenization treatment (for 6 hours); and the homogenized alloy body has the hardness in the range of 430Hv~460Hv after 700° C. of homogenization treatment (for 6 hours).

Seventh Experiment

In the seventh experiment, the metal combination is melted to form the alloys of $Al_{0.3}Cr_{2.5}Fe_{0.2}Mn_{0.2}Mo_{2.5}Ni_{0.2}$, $Al_{0.3}Cr_{3.0}Fe_{0.2}Mn_{0.2}Mo_{2.0}Ni_{0.2}$ and $Al_{0.3}Cr_{2.5}Fe_{0.2}Mn_{0.2}Mo_{1.5}Ni_{0.2}$ by arc-melting. Each alloy is casted to form an alloy body, and the alloy body is subjected to a homogenization treatment (by a heat treatment at 700° C. for 6 hours), and followed by a high-frequency rapid heating treatment separately at 500° C., 800° C. and 1100° C. (for at least 10 minutes) to form a multi-element alloy material.

Figure 8:
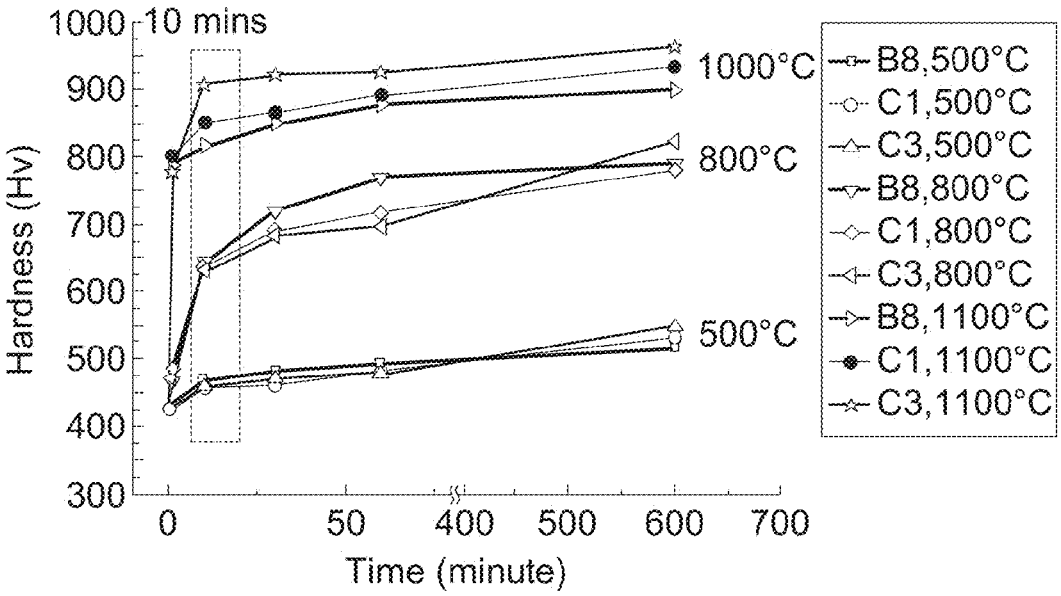
FIG. 8 depicts the heating times of the high-frequency rapid heating treatment versus the hardness of the multi-element alloy. materials of $Al_{0.3}Cr_{2.5}Fe_{0.2}Mn_{0.2}Mo_{2.5}Ni_{0.2}$, $Al_{0.3}Cr_{3.0}Fe_{0.2}Mn_{0.2}Mo_{2.0}Ni_{0.2}$ and $Al_{0.3}Cr_{2.5}Fe_{0.2}Mn_{0.2}Mo_{1.5}Ni_{0.2}$.

FIG. 8 depicts the heating times of the high-frequency rapid heating treatment versus the hardness of the multi-element alloy materials of $Al_{0.3}Cr_{2.5}Fe_{0.2}Mn_{0.2}Mo_{2.5}Ni_{0.2}$, $Al_{0.3}Cr_{3.0}Fe_{0.2}Mn_{0.2}Mo_{2.0}Ni_{0.2}$ and $Al_{0.3}Cr_{2.5}Fe_{0.2}Mn_{0.2}Mo_{1.5}Ni_{0.2}$, wherein the curve (B8) represents the multi-element alloy material of $Al_{0.3}Cr_{2.5}Fe_{0.2}Mn_{0.2}Mo_{2.5}Ni_{0.2}$, the curve (C1) represents the multi-element alloy material of $Al_{0.3}Cr_{3.0}Fe_{0.2}Mn_{0.2}Mo_{2.0}Ni_{0.2}$, and the curve (C3) represents the multi-element alloy material of $Al_{0.3}Cr_{2.5}Fe_{0.2}Mn_{0.2}Mo_{1.5}Ni_{0.2}$. Due to the low thermal conductivity, the multi-element alloy material possesses the property of precipitation hardening at the surface when the high-frequency rapid heating treatment is conducted at a sufficient high temperature (which would be varied with the proportions of different metals of alloys). In the seventh experiment, the three of multi-element alloy materials have excellent property of precipitation hardening at the surface when the high-frequency rapid heating treatment is conducted at a temperature of 800° C. at least. As indicated in FIG. 8, the multi-element alloy materials reveals property of precipitation hardening at the surface when the high-frequency rapid heating treatment is conducted at 800° C. for 10 minutes.

TABLE 1

Mole ratios of metals of the multi-element alloy material of $Al_xCr_yFe_{0.2}Mn_{0.2}Mo_ZNi_{0.2}$

| examples | Al | Cr | Fe | Mn | Mo | Ni |
|---|---|---|---|---|---|---|
| T1 | 0.1 | 2.5 | 0.2 | 0.2 | 1.5 | 0.2 |
| T2 | 0.1 | 3.0 | 0.2 | 0.2 | 2.0 | 0.2 |
| T3 | 0.1 | 3.5 | 0.2 | 0.2 | 2.5 | 0.2 |
| T4 | 0.2 | 2.5 | 0.2 | 0.2 | 2.5 | 0.2 |
| T5 | 0.2 | 3.0 | 0.2 | 0.2 | 1.5 | 0.2 |
| T6 | 0.2 | 3.5 | 0.2 | 0.2 | 2.0 | 0.2 |
| T7 | 0.4 | 2.5 | 0.2 | 0.2 | 2.0 | 0.2 |
| T8 | 0.4 | 3.0 | 0.2 | 0.2 | 2.5 | 0.2 |
| T9 | 0.4 | 3.5 | 0.2 | 0.2 | 1.5 | 0.2 |

TABLE 2

Hardness measurement of the multi-element alloy material of $Al_xCr_yFe_{0.2}Mn_{0.2}Mo_ZNi_{0.2}$ with a high-frequency rapid heating treatment at 500° C. for 15 minutes

| examples | Hardness of Core Zone (Hv) | Hardness of Intermediate Zone (Hv) | Hardness of Surface Zone (Hv) |
|---|---|---|---|
| T1 | 216.5 | 337.6 | 425.2 |
| T2 | 312.6 | 358.6 | 487.1 |
| T3 | 297.6 | 400.1 | 464.1 |
| T4 | 347.4 | 450.4 | 517.4 |
| T5 | 357.5 | 438.8 | 543.9 |
| T6 | 389.1 | 469.7 | 601.8 |
| T7 | 407.5 | 500.1 | 588.1 |
| T8 | 430.6 | 534.1 | 600.1 |
| T9 | 439.5 | 567.3 | 612.0 |

TABLE 3

Hardness measurement of the multi-element alloy material of $Al_xCr_yFe_{0.2}Mn_{0.2}Mo_ZNi_{0.2}$ with a high-frequency rapid heating treatment at 800° C. for 15 minutes

| examples | Hardness of Core Zone (Hv) | Hardness of Intermediate Zone (Hv) | Hardness of Surface Zone (Hv) |
|---|---|---|---|
| T1 | 231.1 | 454.8 | 625.2 |
| T2 | 298.8 | 481.8 | 697.0 |
| T3 | 311.6 | 478.2 | 701.1 |
| T4 | 341.4 | 501.3 | 798.2 |
| T5 | 368.3 | 551.5 | 734.5 |
| T6 | 388.9 | 542.4 | 801.4 |
| T7 | 399.0 | 597.9 | 787.1 |
| T8 | 433.9 | 645.2 | 831.4 |
| T9 | 431.0 | 627.3 | 853.9 |

TABLE 4

Hardness measurement of the multi-element alloy material of $Al_xCr_yFe_{0.2}Mn_{0.2}Mo_ZNi_{0.2}$ with a high-frequency rapid heating treatment at 1100° C. for 10 minutes

| examples | Hardness of Core Zone (Hv) | Hardness of Intermediate Zone (Hv) | Hardness of Surface Zone (Hv) |
|---|---|---|---|
| T1 | 269.1 | 507.3 | 757.2 |
| T2 | 317.0 | 589.2 | 811.2 |
| T3 | 309.4 | 611.6 | 769.5 |
| T4 | 357.1 | 630.4 | 857.3 |
| T5 | 385.2 | 598.2 | 845.2 |
| T6 | 399.6 | 645.4 | 910.3 |
| T7 | 430.0 | 650.6 | 898.4 |
| T8 | 458.5 | 694.0 | 989.9 |
| T9 | 461.7 | 687.2 | 1032.0 |

TABLE 5

Hardness measurement of the multi-element alloy materials of $Al_{0.4}Cr_yFe_{0.2}Mn_{0.2}Mo_ZNi_{0.2}$ with a high-frequency rapid heating treatment at 1100° C. for 10 minutes

| examples | Hardness of Core Zone (Hv) | Hardness of Intermediate Zone (Hv) | Hardness of Surface Zone (Hv) |
|---|---|---|---|
| $Al_{0.4}Cr_{3.5}Fe_{0.2}Mn_{0.2}Mo_{2.0}Ni_{0.2}$ | 450.0 | 791.0 | 954.3 |
| $Al_{0.4}Cr_{3.5}Fe_{0.2}Mn_{0.2}Mo_{2.5}Ni_{0.2}$ | 448.3 | 785.7 | 1005.2 |
| $Al_{0.4}Cr_{4.0}Fe_{0.2}Mn_{0.2}Mo_{2.5}Ni_{0.2}$ | 687.2 | 987.3 | 1232.6 |

TABLE 6

Hardness measurement of the multi-element alloy materials of $Al_{0.4}Cr_{3.5}Fe_{0.2}Mn_{0.2}Mo_{2.5}Ni_{0.2}$ with a high-frequency rapid heating treatment at 1100° C. for different heating times (i.e. 5/10/20 minutes)

| Time | Hardness of Position 1 (Hv) | Hardness of Position 2 (Hv) | Hardness of Position 3 (Hv) | Hardness of Position 4 (Hv) | Hardness of Position 5 (Hv) |
|---|---|---|---|---|---|
| 5 minutes | 662.7 | 588.8 | 537.4 | 454.2 | 398.5 |
| 10 minutes | 989.6 | 872.4 | 779.5 | 548.6 | 469.4 |
| 20 minutes | 1132.3 | 1002.4 | 832.5 | 743.0 | 512.4 |

According to the aforementioned embodiments, the multi-element alloy materials of AlCrFeMnMoNi have a strain fracture toughness (Kic) of 6 at least.

It will be apparent to those skilled in the art that various modifications and variations can be made to the disclosed embodiments. It is intended that the specification and examples be considered as exemplary only, with a true scope of the disclosure being indicated by the following claims and their equivalents.

What is claimed is:

1. A multi-element alloy material, consisting of Al, Cr, Fe, Mn, Mo and Ni, and exhibiting a hardness gradient from high to low correspondingly from an outer surface inward of the multi-element alloy material, wherein the multi-element alloy material is a compound represented by $Al_xCr_yFe_{0.2}Mn_{0.2}Mo_ZNi_{0.2}$, including 0.2 mole of Fe, 0.2 mole of Mn, 0.2 mole of Ni, x mole of Al, y mole of Cr and z mole of Mo, wherein x is ranged from 0.1 to 0.4, y is ranged from 2.5 to 4, and z is ranged from 1.5 to 2.5.

2. The multi-element alloy material according to claim 1, wherein the outer surface exhibits a surface hardness with at least 400Hv, and at least a portion having a thickness of 1 mm horizontally inward from the outer surface exhibits the surface hardness.

3. The multi-element alloy material according to claim 2, wherein a center of the multi-element alloy material has a core hardness of about 300Hv to 500Hv, while the surface hardness is in a range of about 700Hv to 1200Hv.

4. The multi-element alloy material according to claim 1, wherein from the outer surface to the center of the multi-element alloy material presents no distinct interfaces.

5. A method for manufacturing a multi-element alloy material, comprising:

providing a metal combination, consisting of Al, Cr, Fe, Mn, Mo and Ni; melting the metal combination to form an alloy; casting the alloy to form an alloy body; subjecting the alloy body to a homogenization treatment to form a homogenized alloy body; and subjecting the homogenized alloy body to a high temperature treatment to perform precipitation hardening at surface of the alloy body by heating, thereby forming a multi-element alloy material having a hardness gradient, wherein the multi-element alloy material consisting of Al, Cr, Fe, Mn, Mo and Ni, and exhibiting a hardness gradient from high to low correspondingly from an outer surface inward of the multi-element alloy material is a compound represented by Al Cr Fe0.2Mn0.2Mo Ni0.2, including 0.2 mole of Fe, 0.2 mole of Mn, 0.2 mole of Ni, x mole of Al, y mole of Cr and z mole of Mo, wherein x is ranged from 0.1 to 0.4, y is ranged from 2.5 to 4, and z is ranged from 1.5 to 2.5.

6. The method according to claim 5, wherein the high temperature treatment is a high-frequency rapid heating treatment.

7. The method according to claim 6, wherein a treating temperature of the high-frequency rapid heating treatment is in a range of about 500° C. to 1200° C.

8. The method according to claim 6, wherein the high-frequency rapid heating treatment is conducted for about 8 minutes to 20 minutes.

9. The method according to claim 5, wherein from the outer surface to the center of the multi-element alloy material presents no distinct interfaces.

10. The method according to claim 5, wherein an outer surface exhibits a surface hardness with at least 400Hv, and at least a portion having a thickness of 1 mm horizontally inward from the outer surface exhibits the surface hardness.

11. The method according to claim 5, wherein a center of the multi-element alloy material has a core hardness of 300Hv to 500Hv, while an outer surface of the multi-element alloy material exhibits a surface hardness of 700Hv to 1200Hv.

* * * * *